United States Patent [19]

Lindberg

[11] 4,132,247

[45] Jan. 2, 1979

[54] FLUID MIXING APPARATUS

[75] Inventor: John E. Lindberg, Berkeley, Calif.

[73] Assignee: Owen, Wickersham & Erickson, San Francisco, Calif.

[21] Appl. No.: 793,601

[22] Filed: May 4, 1977

[51] Int. Cl.[2] ..... F15C 1/16

[52] U.S. Cl. ..... 137/806; 137/810; 137/216; 137/604; 123/119 A; 123/119 B; 123/119 D; 123/25 E

[58] Field of Search ..... 123/119 A, 119 B, 119 D, 123/119 EE, 25 E, 25 R; 137/480, 805, 806, 808, 809, 810, 811, 812, 813, 216, 217, 604

[56] References Cited

U.S. PATENT DOCUMENTS

| | | | |
|---|---|---|---|
| 1,517,598 | 12/1924 | Stevenson | 137/604 X |
| 2,155,520 | 4/1939 | Wolff | 137/216 |
| 3,578,016 | 5/1971 | Kushner | 137/216 |
| 3,888,556 | 6/1975 | Strong et al. | 137/810 |

FOREIGN PATENT DOCUMENTS

| | | | |
|---|---|---|---|
| 1242644 | 8/1971 | United Kingdom | 137/604 |

*Primary Examiner*—Carlton R. Croyle
*Assistant Examiner*—Leonard E. Smith
*Attorney, Agent, or Firm*—Owen, Wickersham & Erickson

[57] ABSTRACT

A fluid mixing apparatus introduces a controlled amount of gas into a liquid flowing through a conduit.

The fluid mixing apparatus incorporates a flow control device which is constructed to produce a variable impedance to fluid flow through the control device. The impedance varies in a pre-planned relationship to the pressure differential across the flow control device and to an acceleration of the flow within the control device.

The control device has an outlet connected to the interior of the liquid carrying conduit and has a gas inlet for supplying the gas to the interior of the control device.

In a specific embodiment, the flow control device is a vortex chamber which produces rotation of the gas flowing through the gas inlet. This rotation produces a self-choking effect on the gas flowing from the inlet to the outlet. A varying ratio of air to liquid is produced in the liquid conduit downstream of the connection to said outlet with changes in the pressure differential across the control device, and the amount of liquid in relation to the amount of air increases greatly with relatively small increases in the pressure differential across the control device.

10 Claims, 7 Drawing Figures

FLUID MIXING APPARATUS

BACKGROUND OF THE INVENTION

The present invention relates to a fluid mixing mechanism for introducing a controlled amount of gas into a liquid flowing through a conduit.

A siphon break is a well-known prior art construction which can function, within limits, to provide some mixing of a gas with a liquid until the siphon break interrupts all liquid flow at a certain level of suction on the liquid line or conduit. In a siphon break an air line (having a fixed, inner restriction) is connected into the interior of a fluid conduit. The conventional prior art siphon break serves the primary function of breaking or stopping the flow of liquid through the conduit under certain circumstances. Thus, in a case where the liquid flow through the conduit is produced by a siphoning action and it is desired to interrupt the siphoning flow when the suction decreases to a certain amount, the air tube can incorporate a fixed orifice which will permit air to bleed in to the interior of the liquid tube faster than the suction will draw the liquid through the tube, so that the suction or siphoning of the liquid is broken at that amount of suction (or at lower amounts of suction).

This prior art type of siphon break incorporates a fixed orifice that does not have any changing characteristics. The fixed orifice must be made large enough, or small enough, to do a particular job; but the fixed orifice might then be completely unsatisfactory for operation at any, or all, other conditions.

In many applications, there is a need to provide a controlled mixing of liquid and gas over a wide range of suctions (or other pumping of fluid flow) through the liquid conduit. The prior art, fixed orifice siphon break type constructions can not provide a controlled variation of the mixing of gas and liquid flow because the prior art fixed orifice type of siphon break construction cannot provide the required large variation in the ratios of gas to liquid flow with changing flow conditions.

It is a primary object of the present invention to control the mixing of a gas with a liquid flowing through a conduit in a way which avoids the problems of the prior art fixed orifice siphon break construction.

It is a related object of the present invention to introduce a controlled amount of gas into a liquid flowing through a conduit by a control mechanism which is constructed to produce a variable impedance to fluid flow through the control mechanism and to cause the impedance to vary in a non-linear relationship to the pressure differential across the flow control mechanism and to an acceleration of the flow through the control mechanism.

SUMMARY OF THE INVENTION

In the present invention, a variable impedance flow control device has an outlet connected to the interior of a liquid carrying conduit. The control device has a gas inlet for admitting air (or other gas) to the interior of the control device; and the control device is constructed to produce an acceleration of the flow from the inlet to the outlet and to produce by the acceleration and impedance which varies in a controlled relationship to the pressure differential across the control device.

In a specific embodiment, the control device is a vortex chamber. The vortex chamber produces a rotation of the gas flowing through it so that the vortex flow produces a self-choking effect by its own flow. As the pressure differential between the inlet and outlet of the vortex chamber increases, the incoming gases are forced to spin faster and thereby to produce a greatly increased impedance to gas flow through the vortex chamber. Since less gas can flow through the vortex chamber, less gas is mixed with the liquid in the liquid conduit; and the ratio of liquid to gas in the conduit downstream of the outlet connection to the vortex chamber increases substantially with relatively small increases in pressure differential between the inlet and outlet of the vortex chamber.

In another embodiment of the present invention, a second, liquid inlet is connected to the vortex chamber. The second, liquid inlet includes a tube which has one end connected to the liquid carrying conduit at a point upstream of the outlet connection to the vortex chamber. The other end of the liquid inlet tube is disposed within the interior of the vortex chamber at a location where it is subjected to a suction by the swirl of gases produced within the vortex chamber. Increased gas flow to the vortex chamber produces greater suction on the end of the liquid inlet tube and at a certain level of suction draws liquid from the inlet tube into the vortex chamber. This added liquid produces a further choking effect on the total flow through the vortex chamber to further reduce the amount of gases that are mixed with the liquid in the liquid carrying conduit.

Fluid mixing mechanisms and techniques which incorporate the structural features noted above and which are effective to function in the ways described above constitute further, specific objects of the present invention.

BRIEF DESCRIPTION OF THE DRAWINGS

FIG. 4 is taken along the line and in the direction indicated by the arrows 4—4 in FIG. 5.

DETAILED DESCRIPTION OF THE PREFERRED EMBODIMENTS

Figure 1:
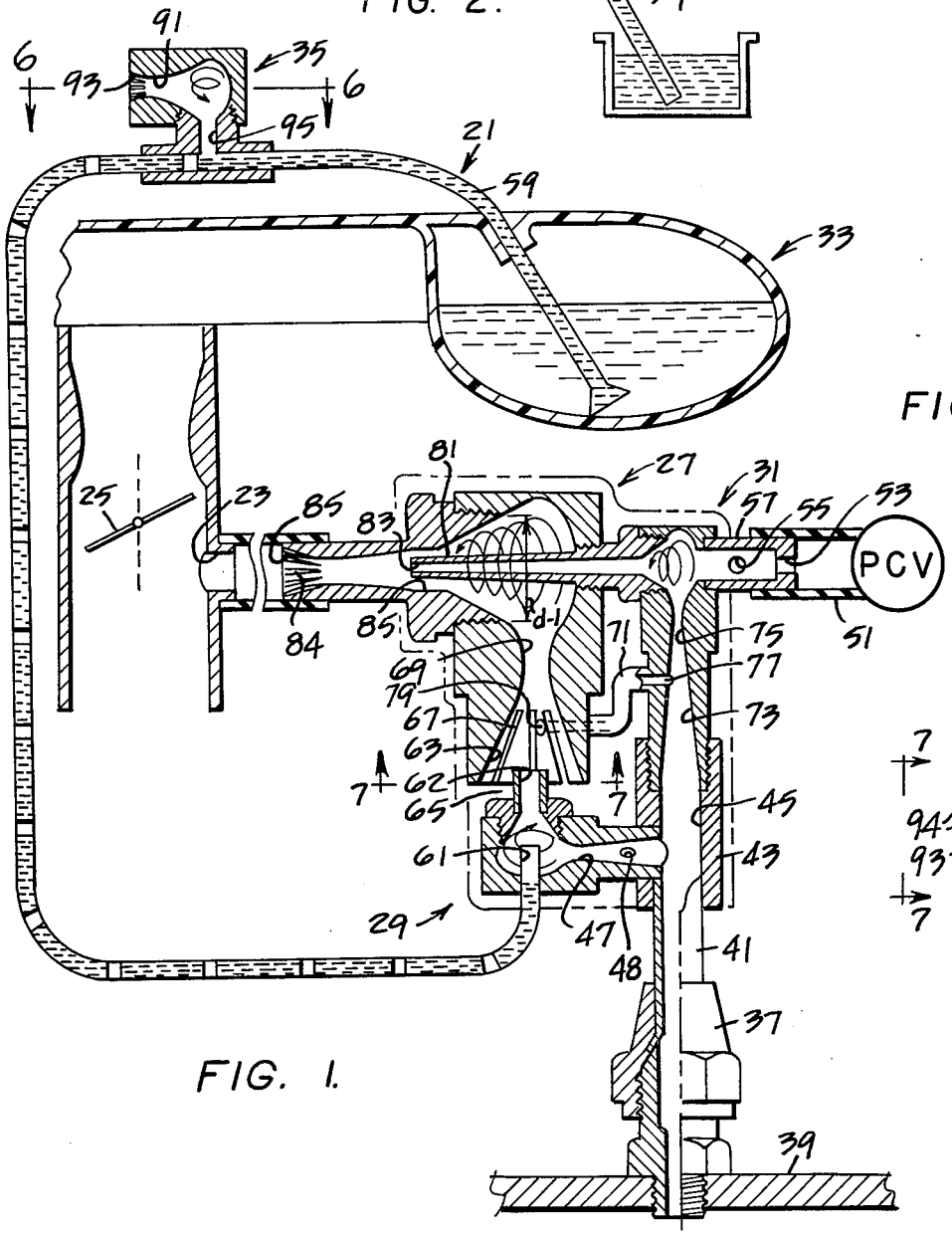
FIG. 1 is a side elevation view of a combustion control system for an internal combustion engine incorporating a siphon break constructed in accordance with one embodiment of the present invention.

FIG. 1 is a side elevation view of a combustion control system 21 for an internal combustion engine, incorporating a fluid mixing apparatus 35 constructed in accordance with one embodiment of the present invention.

The entire combustion control system 21 is illustrated, and will be described, to show one particular embodiment in which the fluid mixing apparatus 35 can be incorporated. The fluid mixing apparatus of the present invention is, however, useful in applications other than combustion control systems for internal combustion engines.

Considering first the construction and mode of operation of the entire combustion control system 21, the system 21 is constructed to inject a mixture of liquid vapor, or in some cases liquid droplets, air, exhaust gases and PCV gases through an opening 21 which is the existing PCV entrance to the manifold below the carburetor butterfly 25.

As used in this specification, PCV gases means the gases produced by positive crank case ventilation.

The major components of the system 21 shown in FIG. 1 comprise an air vortex chamber 27, a liquid vortex chamber 29, an exhaust gas and PCV gas vortex chamber 31, a liquid reservoir 33, and a fluid mixing apparatus.

In a particular embodiment, the smallest vortex chamber is the vortex chamber 29, which is about one-half the diameter of the vortex chamber 31, and the vortex chamber 31 is two-thirds the diameter of the vortex chamber 27.

One purpose of the fluid mixing apparatus 35 is to disconnect the liquid reservoir 33 from the liquid vortex chamber 29 on three conditions—engine off, engine idle, and engine deceleration. The way in which the apparatus 35 performs these functions will be described in more detail below.

The apparatus 35 also provides another function. It aids in controlling the rate of increase of fluid flow in relation to increase of engine power, and this will also be described in greater detail below.

The apparatus 35 also serves as protection against liquid lock. When the engine is off, the apparatus 35 physically breaks the siphoning effect of the conduit 59 with respect to the liquid in the reservoir 33 so that no liquid can flow through the conduit 59 when the engine is off.

The present invention incorporates a number of additional protections against liquid lock.

The outlet end 61 of the conduit 59 is disposed within the water vortex chamber 29 at a level which is below the level of entrance 23 so that, even in the event of some failure of the apparatus 35, liquid cannot flow upward from the outlet end 61 to the inlet 23 when the engine is not operating.

Engine exhaust gases are conducted from a PCV outlet fitting connected to the exhaust gas manifold 39 of the engine immediately adjacent to one of the cylinders, so as to obtain the highest exhaust gas temperatures. These exhaust gases are conducted through a conduit 41 to a branched fitting 43 which provides one conduit 45 for conducting a portion of the exhaust gases to the exhaust gas vortex chamber 31 and which provides a second conduit 47 for conducting some of the exhaust gases to the liquid vortex chamber 29.

In a preferred form of the invention, the vortex chambers are insulated by thermal insulation (indicated by the dashed outline in FIG. 1) to preserve the heat of the exhaust gases used in the vortex chambers.

The structural part of the system 21 containing the vortex chambers 27, 29, and 31 is preferably located as closely as possible to an exhaust valve in the exhaust manifold 39 to maximize the amount of heat which is transmitted to these vortex chambers.

The PCV gases are conducted to the exhaust gas vortex chamber 31 by means of a PCV fitting connected to the rocker box cover of the engine in the normal manner. This PCV fitting 49 is connected to the rocker box cover of the engine in the usual manner. A tubular conduit 51 carries the exhaust gases to a control orifice 53, and the control orifice 53 regulates the flow of the PCV cases to the exhaust gas vortex chamber 31.

Bleed or additional air for combustion control is also admitted to the exhaust gas vortex chamber 31 through an opening 55 formed in a sidewall of the conduit 57 leading axially into the interior of the exhaust gas vortex chamber 31.

Liquid from the reservoir 33 is conducted to the water vortex chamber 29 through a conduit 59. The liquid conducted through the conduit 59 can be, for example, water alone, or water plus alcohol, hydrogen peroxide, ammonia, upper cylinder lubricants, or solvents or other additives as desired.

The outlet end 61 of the conduit 59 is located within the interior of the liquid vortex chamber 29 on the axial center line of the air vortex chamber 29. The extent to which the end of the inlet tube 61 extends into the vortex chamber provides a control variable regulating the amount of suction exerted on the liquid inlet 61 of the conduit 59.

A second control parameter for regulating the amount of suction is the diameter of the inlet tube 61, particularly in relation to the overall diameter of the interior of the vortex chamber.

Thus, moving the outlet end 61 further into the interior of the vortex chamber 29 (upward as viewed in FIG. 1) increases the suction, and providing a smaller diameter for the inlet tube 61 increases the suction.

Further, any liquid flowing through the conduit 59 in the event of the failure of the apparatus 35 has a large number of outlets so that it could never accumulate to a point where it could overflow into the opening 23. For example, the water flowing from the outlet 61 has a free path through the conduit 47 and conduit 41 to the interior of the exhaust manifold 39. The fluid also has a free outlet from the outlet end 61 through the conduit 62 and out the opening between the liquid vortex chamber 27 and the inlet 63 of the air vortex chamber 27. There are also outlets through the slots 67.

Air is admitted to the air vortex chamber 27 through a curved opening 63. In the embodiment shown in FIG. 1 the curved opening 63 has a generally conical shape so that the diameter of the opening 63 decreases with nearness to the interior of the air vortex chamber 27.

Figure 7:
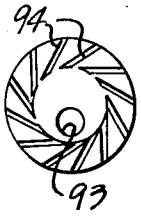
FIG. 7 is a view taken along the line and in the direction indicated by the arrows 7—7 in FIG. 6 and shows the inclination of the slots 94 for imparting a spin to the fluid entering the passageway 93.

The air comes into the opening 63 both through the space 65 between the outlet of the liquid vortex chamber 29 and the inlet to the curved opening 63 and also through slots 67 formed in the sidewall of the curved opening 63 and disposed tangentially to the inner surface of the curved opening 63 at the upper, inner end of each slot 67. See FIG. 7.

Air coming into the curved opening 63 is transmitted to the interior of the air vortex chamber 27 through a throat 69. The throat 69 comes in generally tangential to the interior of air vortex chamber 27.

As illustrated in FIG. 1, a branch conduit 71 interconnects the interior of the curved opening 63 with a tapered passageway 73 for conducting the exhaust gases from the conduit 45 to the interior of the exhaust vortex chamber 31.

The tapered passageway 73 has formed, at the upper end as viewed in FIG. 1, a throat 75 of minimum diameter at the point of connection to the interior of the exhaust gas vortex chamber 31. This throat 75 is aligned tangentially with the interior of the vortex chamber 31 in the same way as the throat 69 is aligned tangentially with the interior of the vortex chamber 27.

The end 77 of the conduit 71 which connects to the tapered passageway 73 is connected tangentially to the inside surface of the passageway 73 for a control purpose which will be described in more detail below.

The other end 79 of the conduit 71 connected to the interior of the curved opening 63 is also aligned tangentially with the interior of that opening, but in opposition to the tangency of the slots 67, and the control purpose for this alignment will also be described in greater detail below.

The outlet of the exhaust gas vortex chamber 31 comprises a tapered tube 81 which extends completely into the interior of the air vortex chamber 27. The extent to which the outlet tube 81 extends into the interior of the air vortex chamber 27 provides a control parameter for regulating the amount of air and liquid introduced through the air vortex chamber 27 as the power of the engine increases depending upon the length of the tube 81. That is, to maximize the amount of air and liquid transmitted through the air vortex chamber 27, the length of the tube 81 is increased to give an ejector like action at the outlet of the vortex chamber 27, as illustrated in FIG. 1. The tube 81 may extend completely through the length of the air vortex chamber 27 so that the outlet end 83 is so disposed with respect to the outlet 85 of the air vortex chamber 27 as to give an ejector like action for increasing the flow through the air vortex chamber 27.

As illustrated in FIG. 1, the outlet 85 is preferably formed as a true Venturi so that the outlet end is of an expanding shape so that a true Venturi action is provided to minimize restriction to flow through the opening 85 at all conditions of flow encountered in normal operation.

However, to increase the turbulence at the end of the outlet 85 of the air vortex chamber, the inside surface of the end of the outlet 85 can be formed with serrations or grooves 84 extending parallel to the axis of the outlet 85. These serrations or grooves can also be located at the minimum throat area of the exit Venturi 85 and serve to produce an ultrasonic wave form in the fluids flowing through this outlet.

The existing PCV opening 23 in the inlet manifold is a convenient point for introducing the mixture of air, liquid, exhaust gases, and PCV gases of the system 21 shown in FIG. 1 for a number of reasons. This opening is present in most conventional automobile engines, it is easy to make a connection to, and the pressure below the butterfly valve 25 does have a relationship to the amount of additional air and liquid that it is desired to introduce through the opening 23 at the various engine operating conditions.

However, the relationship is an inverse relationship. That is, the highest vacuum below the butterfly valve 25 at the opening 23 exists at idle and the lowest vacuum exists at full throttle. At idle and at engine deceleration, it is desirable that no water or other liquid or liquid vapor be introduced; and the maximum amount of liquid and additional air should be introduced through the opening 23 at full throttle. Thus, the relationship between the pressure differential across the air vortex chamber 27 produced by various conditions of engine operation is inversely related to the amount of materials to be injected through the opening 23 at the various engine operating conditions.

It is a general principle of operation of a vortex chamber that the flow through the vortex chamber varies as the square root of the pressure differential across the vortex chamber. The effect of the vortex chamber 27, by itself, and disregarding for the moment the configured inlet 63 to the vortex chamber, is therefore to reduce the effect of the pressure differential across the vortex chamber in relation to the flow through the vortex chamber by a factor which can be as great as 5:1 or even somewhat greater, depending upon the actual amount of the vacuum below the butterfly valve 25.

The vortex chamber 27, again standing by itself, therefore acts as a variable impedance device whose impedance to flow increases with an increase in the differential across the vortex chamber.

The system 21 of the present invention also incorporates a fluidic valve at the entrance to the air vortex chamber 27 which also functions as a variable impedance device but whose impedance can be controlled and varied by the structural features incorporated in or associated with the entrance.

Thus, the fluidic valve formed at the entrance to the air vortex chamber 27 acts to further choke off flow, in the embodiment shown in FIG. 1, at idle and on engine deceleration to achieve substantially a complete cut off of flow through the air vortex chamber 27 under these conditions of engine operation.

The impedance of this fluidic valve is controlled by the slots 67 which increase the spinning effect to increase the choke effect as the pressure differential across the vortex chamber 27 increases.

The slots 67 thus act to increase the impedance with increasing pressure differentials (with increasing vacuum in the engine inlet manifold below the butterfly valve 25).

In the embodiment of the system 21 shown in FIG. 1 the liquid vortex chamber 29 and the branch conduit 71 are normally arranged to reduce the impedance of the fluidic valve at the inlet to the air vortex chamber 27 which increasing exhaust gas pressure produced by higher power levels of operation of the engine.

Thus, the liquid vortex chamber 29, in the embodiment shown in FIG. 1, injects the liquid and exhaust gases into the curved inlet 63 with a direction of spin that is opposite to the direction of spin produced by the slots 67; and the branch conduit 71 transmits pressurized exhaust gases from the conduit 43 to the curved inlet 63 in a direction of spin which is also opposite the direction of spin produced by the slots 67. The water vortex chamber 29 and the branch conduit 71 thus reduce the impedance of the fluidic valve at the inlet to the air vortex chamber 27 as the engine power increases and this tends to increase the amount of materials which flow through the air vortex chamber 27 as the engine power goes up, even though the vacuum below the butterfly valve 25 is decreasing as the engine power goes up.

It should be noted, however, that the direction of spin at the outlet of the liquid vortex chamber 29 can be aligned to be in the same direction as the direction of spin imparted by the slots 67 to provide an increased choking effect in the inlet 63 with increasing engine power if this is required for a particular engine application.

The main reversal effect of the system 21 shown in FIG. 1 (that is the increase of injected liquid, air, exhaust gases and PCV gases with increased engine power and decreased vacuum below the butterfly valve 25) is however provided by the ejector effect of the outlet end 83 of the tube 81 at the outlet 85 of the air vortex chamber.

As the engine power goes up, the pressure of the exhaust gases transferred through the conduit 41 and the shaped inlet 75 to the exhaust gas vortex chamber 31 increases, and this increases the flow through the exhaust gas vortex chamber 31.

The shaped inlet 73 to the exhaust gas vortex chamber 31 in combination with the branch conduit 71 provides a step function change in the operation of the exhaust gas vortex chamber 31 to accomplish both a choking effect on the inlet to the exhaust gas vortex chamber at idle and deceleration and at low rpm (to desirably restrict the flow of exhaust gas to the intake manifold under these conditions of engine operation) and also to remove the choking effect and thereby to permit increased flow through the exhaust gas vortex chamber at higher rpm all the way up to maximum power.

These results are produced as follows.

At idle and at low rpm and under deceleration conditions, the pressure at the end 79 of the branch conduit within the shaped opening 63 is enough greater than the pressure at the end 77 of the branch conduit within the inlet 73 so that the flow through the branch conduit 71 is from the opening 79 to the opening 77, and this causes the spin within the inlet 73 to cause a choking effet to restrict the flow of exhaust gases through this inlet 73 to the exhaust gas vortex chamber 31 at idle and below, for example at 900 rpm and below. As the exhaust gas pressure is increased, however, at higher engine rpms, the pressure at the end 77 becomes greater (between 900 and 1500 rpm) than the pressure at the end 79 so that the direction of flow of gases through the conduit 71 reverses; and this decreases the choking effect in the inlet 73 (while simultaneously decreasing the choking effect in the opening 63 also because of the direction of spin); and the effect on the exhaust gas vortex chamber 31 is to permit a substantially increased amount of exhaust gases to flow into and through the vortex chamber 31. This in turn draws in more air through the air inlet opening 55, draws in a greater amount of PCV gases through the control orifice 53 and acts through the ejector effect at the outlet end 83 of the tube 81 to augment or draw more air and entrained liquid from the air vortex chamber 27 (providing the reversal effect with relationship to the decreasing vacuum below the butterfly valve 25 with increased engine power as described above).

The exhaust gas vortex chamber 31 in combination with the shaped inlet 73 and branch connector 71 thus provide the desired mode of operation of restricting the flow of exhaust gases and PCV gases to the engine at idle and deceleration.

As illustrated in FIG. 1, the inlet 47 to the liquid vortex chamber 29 may also be provided with a tapered configuration as illustrated, and with an air bleed hole 48 which comes in tangentially to the tapered inlet. The combination of the tapered configuration and the tangential air bleed 48 further restricts the amount of exhaust gases admitted to the liquid vortex chamber 29 (and thus the air vortex chamber 27) at idle and on deceleration. This restriction on the inlet to the vortex chamber 29 also cuts down the amount of liquid which can flow out of the vortex chamber 29 at idle and on deceleration.

On acceleration, the increased pressure of the exhaust gases removes the choking effect by eliminating the swirling effect to provide the full, desired amount of liquid from the liquid vortex chamber 29 on acceleration.

The system 21 substantially reduces the amount of PCV gases transmitted through the inlet 23 at engine idle, deceleration, and low rpms (over what would be introduced without the choking effect of the shaped inlet 73) while permitting greater amounts of PCV gases to be transmitted through the exhaust gas vortex chamber 31 to the inlet 23 at higher engine rpm and exhaust gas pressures; but the overall result is a substantially stabilized and moderate increases of PCV gas glow with increasing engine power over the entire range of engine operating conditions. This results from the combination of the choking and de-choking of the entrance 73 and the basic principle of operation of the vortex chamber 31 (which basic principle is to provide a mass flow which is related to the square root of the pressure differential across the vortex chamber.

The total flow through the exhaust gas vortex chamber 31, however, increases substantially with the increased exhaust gas pressures to produce an increased ejector effect at the outlet end 83 for providing increased mass flow of fluid through the air vortex chamber 27 with increased power levels of operation of the engine.

The stabilized effect on the regulation of the flow of the PCV gases produced by the system of the present invention permits the conventional, existing PCV valve to be eliminated, is desired; or the system 21 can be used with the conventional PCV valve in place.

The liquid vortex chamber 29 is, in most respects, effectively de-coupled from the curved entrance 63 to the air vortex chamber 27. This is achieved by the space 65 between the outlet of the liquid vortex chamber 29 and the entrance 63 and also by the effect of the slots 67 which, as described above, provide a spin which is in opposition to the direction of the materials flowing out of the liquid vortex chamber 29.

The slots 67 thus provide a substantial choke effect which effectively de-couples the liquid vortex chamber 29 under idle conditions, deceleration, and low rpm operation of the engine.

It should be noted, however, that the outlet of the air vortex chamber 29 can be utilized to produce an ejector effect, like the output end 83 of the exhaust gas vortex chamber 31. The extent of this ejector effect is dependent upon the location of the outlet end 62 with respect to the curved opening 63. Thus, by extending the outlet end 63 higher into the tapered opening 63, a greater ejector effect is obtained; and this ejector effect can also be utilized to provide, in effect, a reversal of the mass flow through the air vortex chamber 23 with respect to the normal flow of material through the air vortex chamber 27 which would be produced by the pressure differential resulting from the changing vacuum conditions below the butterfly valve in the inlet manifold.

A further control parameter for controlling the mass flow of the material introduced through the opening 23 is obtained by making the outlet 85 in the shape of a Venturi having a smaller minimum diameter than the minimum diameter of the outlet of the air vortex chamber 27, so that the Venturi throat itself provides a choking effect on the outlet of the air vortex chamber 27. The choking effect, in a preferred embodiment of the present invention, is made a variable choking effect by providing counter rotation for the materials flowing out of the outlet end 83 with respect to the materials flowing through the outlet of the air vortex chamber 27. That is, in a preferred embodiment, the directions of spin are opposite and changing mass flows provide changes in the choking effect. In another embodiment, the directions of spin can be in the same direction, but this provides less response of change in choking effect with changes in more flows, but it has the advantage of creating greater turbulence.

In a preferred embodiment of the present invention at low power, the primary spin is provided by the spinning mixture from the outlet of the air vortex chamber 27, while at high power the primary spin is provided by the spinning mixture leaving the outlet 83 of the exhaust gas vortex chamber 31.

At full power, it is desirable that the energies of these two rotating mixtures be balanced to minimize the choking effect. Therefore, the relative sizes of the inside diameter of the outlet tube 83 and the diameter of the outlet end 85 of the air vortex chamber 27 are so related that the mass flows and directions of spin of these two mass flows balance each other out.

The vortex chambers 27, 29, and 31 act in a beneficial way in conjunction with the pulsed, peaked characteristic of the exhaust gas pressure produced by picking up the exhaust gas pressure near the exhaust valve. This is, the pressure of the exhaust gas transmitted through the conduit 41, 45, and 47 varies in a cyclic way with alternate pressure peaks rather than remaining at a steady state, uniform pressure level at any given condition of engine operation. The vortex chamber provides a stabilizing, de-sensitizing effect because the flow through the vortex chamber is dependent upon the square root of the pressure differential across the vortex chamber, rather than being linearly proportional to the differential pressure across the vortex chamber.

The vortex chamber thus acts somewhat like a rectifier with respect to the pulses in the exhaust gas pressure.

In another embodiment of the present invention, as noted above, the two mass flows are permitted (as illustrated in FIG. 1) to spin in the same direction. While this provides an increased choking effect, it also provides increased turbulence of the flow going through the opening 23 and into the inlet manifold thereby to provide better mixing with the air and fuel. In this embodiment of the present invention, the other control parameters can be and are utilized to provide the desired relationship of increased liquid and injected air flow within increasing engine power levels. That is, there are enough control variables in the system 21 shown in FIG. 1 to permit the desired relationship of mass flows with changing suction below the butterfly valve 25 to be realized, even though the directions of spin at the outlets 83 and 85 are in the same direction.

For this particular embodiment of the present invention, the opening 85 need not be a Venturi, but can be a straight tubular opening since a choking effect and change in the choking effect is not relied on at this point.

In a particular embodiment of the present invention, the system 21 has been installed on a Dodge Dart slant six cylinder 225 cubic inch displacement engine.

In this embodiment, the system 21 shown in FIG. 1 incorporates the specific structural features having the dimensions and particular relationships described below.

The ported vent opening 23 has a diameter of 0.250 inch.

The minimum diameter of the exit Venturi 85 is 0.128 inch.

The diameter d-1 shown in FIG. 1 is 0.4375 inch; and, in this specific embodiment, the tube end 83 terminates at the location indicated by the diameter d-1 (rather than extending further into the outlet Venturi 85, as illustrated in FIG. 1). The tube 83 is ⅜ inch long, measured from the point at which it enters the vortex chamber 27 to the end of the tube.

The air vortex chamber 27 imparts a counterclockwise direction of spin to the air and liquid (as viewed from a direction looking from the back of the vortex chamber 27 toward the ported vent 23).

The maximum diameter d-2 of the air vortex chamber 27 is 0.575 inch. (See FIG. 2.)

The equivalent maximum diameter of the exhaust gas-PCV gas vortex chamber 31 is 0.45 inch.

The equivalent maximum diameter of the liquid vortex chamber 29 is 0.37 inch.

The diameter of the orifice 55 is 0.052 inch.

The diameter of the restricter 53 is 0.092 inch.

The minimum diameter of the throat 75 is 0.120 inch.

The inside diameter of the tube 83 is 0.215 inch.

The inside diameter of the tube 71 opening into the throat 73 is 0.08 inch.

The length of the space 65 between the housing for the liquid vortex chamber 29 and the inlet of the curve opening 63 is 0.04 inch.

The conduit 59 has a 1/32 inch inside diameter.

The slots 67 are 0.062 inch wide. There are twelve slots 67.

The inside diameter of the conduit 41 is 0.29 inch. The outside diameter of this conduit is ⅜ inch and the fitting 37 is a ⅜ inch flare pipe fitting the standard ⅛ inch fitting illustrated to enter into the sidewall of the exhaust manifold 39.

The conduit 59 has a 3/32 inch outside diameter and a 1/32 inch inside diameter. The inside diameter of the outlet 62 is 0.125 inch.

The minimum diameter at 69 is 0.165 inch.

The maximum width and depth of the slots 84 is approximately 0.02 inch.

The minimum diameter of the throat 47 is 0.116 inch. The inside diameter of the air hold 48 is 0.062 inch. The maximum diameter of the throat 47 is 0.25 inch.

The minimum diameter of the inlet 93 for the siphon break vortex chamber 35 is 0.055 inch. The maximum internal diameter of the chamber is 0.355 inch.

The inside diameter of the outlet 95 is 0.055 inch.

As noted above, a fluid mixing apparatus 35 is incorporated in the conduit 59 between the reservoir 33 and the outlets 61. A primary purpose of this apparatus 35 is to prevent flow of liquid through the conduit 59 when the engine is in an off, idle, or decelerated condition of operation.

The apparatus 35 actually breaks the connection to prevent siphoning of fluid under these conditions of operation. The fluid mixing apparatus 35 includes a vortex chamber 91 having an air inlet 93 and an outlet 95 for introducing a variable amount of air into the conduit 59, depending upon an indirect relationship to the amount of vacuum seen by the outlet end 61 of the conduit 59.

Thus, at engine idle, there is little flow of exhaust gas through the conduit 47 and therefore almost no suction at the outlet end 61 of the conduit 59.

However, even though there is low suction around the outlet 61 at low power, there can be enough suction to produce some flow through the conduit 59 at idle, if the apparatus 35 were not incorporated in the system 21.

The vortex chamber of the apparatus 35 provides a variable impedance which makes the apparatus practical and useful for insuring the cut-off of liquid flow through the conduit 59 at idle and at low power.

Figure 2:
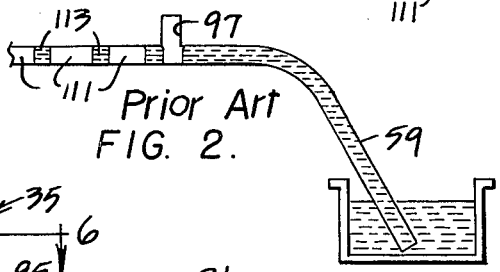
Prior Art FIG. 2.
FIG. 2 is a showing of a prior art siphon break for comparison with the variable impedance siphon break shown in FIG. 1.

This is best understood by reference to FIG. 2, showing a conventional, prior art type of siphon break comprising just an opening 97 in a side wall of the conduit 59. With this prior art type of siphon break, the opening 97 must be made so small (to permit liquid to be siphoned through the conduit 59 during operation of the engine at high power levels) that the opening 97 could not provide any insurance against some flow of liquid through the conduit 59 at engine idle. The required small size of the opening 97 is also compounded by the capillary effect which can have the result of closing off the opening 97 by the capillary action of the fluid itself in the conduit 59. Clogging of the small orifice by dirt or other foreign matter can also be a problem with the prior art siphon break shown in FIG. 2.

In contrast, the fluid mixing apparatus 35 shown in FIG. 1 and incorporating a vortex chamber 91 utilizes a relatively large opening 95 opening in the conduit 59 and is effective to restrict air bleed into the conduit 59 at low vacuums or under conditions of engine operation at higher power levels, because the vortex chamber 91 provides a high enough impedance to flow of air from the inlet 93 to the outlet 95 to effectively block off enough of the air flow so that the ratio of air to liquid in the conduit 59 is a quite low ratio when the engine is operating at higher rpm.

Thus, at higher power levels, the exhaust gas pressure in the conduit 41 is higher, producing increased rates of flow through the water vortex chamber 29, and this in turn produces increased suction at the outlet 61. The increased higher suction at the outlet 61 provides a greater pressure differential across the vortex chamber 91 and increases the impedance to flow through the vortex chamber 91. This in turn decreases the amount of air in relation to the amount of liquid which is permitted to flow through the conduit 59. The vortex chamber 91 thus creates its own increases impedance to flow with increased pressure differential across the vortex chamber, which is the result that is desired for the fluid mixing apparatus in this system.

Figure 6:
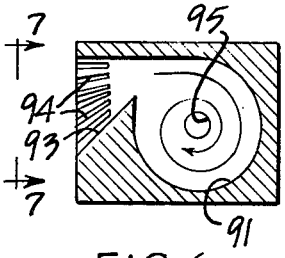
FIG. 6 is a cross-section view taken along the line and in the direction indicated by the arrows 6—6 in FIG. 1.

As best shown in FIG. 6 the inlet 93 is preferably a shaped inlet of decreasing internal diameter so that a swirl can be produced in the inflowing air to provide a controlled choking in the inlet 93. A number of slots 94 extend through the sidewall of the inlet 93 and open tangentially to the inner surface of the inlet 93 to produce the swirl in the same was as the slots 67 in the inlet 63 as described above.

Figure 3:
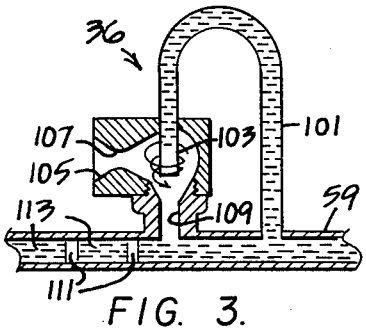
FIG. 3 is a side elevation view of another embodiment of a siphon break constructed in accordance with the present invention. In the FIG. 3 embodiment liquid is brought into the vortex chamber on axis and for the purpose of increasing the impedance to flow in the exit of the vortex chamber by causing the vortex chamber to draw high density fluid into the system.

FIG. 3 is a side elevation view of another embodiment of a fluid mixing apparatus constructed in accordance with the present invention. In FIG. 3 the fluid mixing apparatus is indicated generally by the reference numeral 36.

In the FIG. 3 embodiment, the liquid is brought into the vortex chamber on axis (that is, aligned with the axis of spin of the air within the vortex chamber) and for the purpose of increasing the impedance to flow in the exit of the vortex chamber to draw high-density fluid into the system.

As illustrated in FIG. 3, the fluid is conducted to the interior of the vortex chamber 36 by a branch conduit 101 feed into the main fluid conduit 59. The branch conduit 101 has an end 103 which, in a preferred form of the invention, extends inwardly down to and within the cone of rotating air formed within the vortex chamber 36.

Air is admitted to the interior of the vortex chamber by a shaped opening 105, which tapers to a throat 107.

The air and entrained liquid exit from the vortex chamber by an outlet 109 which connects back to the interior of the conduit 59.

The spin imparted to the incoming air by the inner surface of the vortex chamber 36 produces a suction at the tube end 103, and the liquid drawn into the spinning air acts to block partially the outlet opening 109 to increase the total impedance of the vortex chamber 36, and the overall result is to provide less air in relation to the fluid flowing in the conduit 59 downstream of the opening 109 than is produced with the vortex chamber 91 of the FIG. 1 embodiment. The vortex chamber 35 of the FIG. 1 embodiment produces a substantially increased ratio of liquid to entrained air in comparison to the ratio produced by the prior art siphon break shown in FIG. 2, and the FIG. 3 embodiment produces a substantially greater ratio of liquid to air than the FIG. 1 embodiment. This is illustrated diagrammatically in the FIGS. 1, 2, and 3 drawing views where the spaces 111 indicate air and the spaces 113 indicate fluid.

Figure 5:
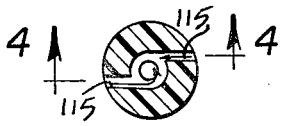
FIG. 5 is a plan view taken along the line and in the direction indicated by the arrows 5—5 in FIG. 4. The embodiment of the siphon break shown in FIGS. 4 and 5 incorporates a vortex chamber having two tangential air bleed inlets with restricted openings and which can be made inexpensively from a plastic molding.
Figure 4:
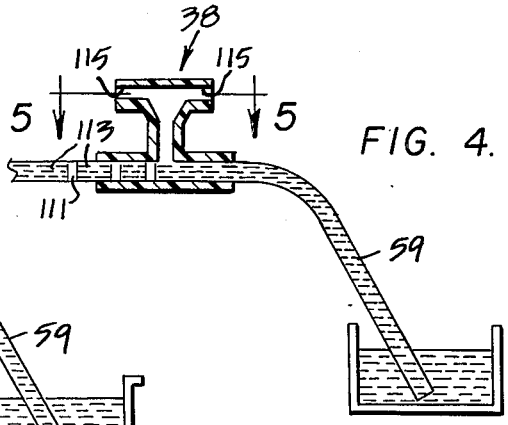
FIG. 4 is a side elevation view of another embodiment of a siphon break constructed in accordance with the present invention.

The ratios of air to water in the different embodiments shown in the drawings are approximately as follows:

FIG. 2 about 90% air and 10% liquid;

FIGS. 4 and 5 about 10% air and 90% water;

FIG. 3 about 95% liquid or water and 5% air.

FIG. 4 is a side elevation view of another embodiment of a fluid mixing apparatus constructed in accordance with the present invention. In FIG. 4 the fluid mixing apparatus is indicated generally by the reference numeral 38.

The apparatus 38 shown in FIGS. 4 and 5 incorporates a vortex chamber having two tangential air bleed inlets with restricted openings 115 for providing a higher impedance device than that illustrated in FIG. 1 or FIG. 3. The apparatus illustrated in FIGS. 4 and 5 can also be constructed inexpensively from a plastic molding.

The FIG. 4 vortex chamber is, in effect, an alternate form of the FIG. 1 apparatus 35 with the FIG. 4 embodiment having two air inlets with restricted openings.

While I have illustrated and described the preferred embodiments of my invention, it is to be understood that these are capable of variation and modification and I therefore do not wish to be limited to the precise details set forth, but desire to avail myself of such changes and alterations as fall within the purview of the following claims.

I claim:

1. A fluid mixing apparatus for introducing a controlled amount of gas into a liquid flowing through a conduit, said fluid mixing mechanism comprising a liquid carrying conduit, variable impedance flow control means for producing a variable impedance to fluid flow through the control means which impedance varies in a non-linear relationship to the pressure differential across the flow control means and to an acceleration of the flow through the control means, outlet means connecting an outlet of the variable impedance control means to the interior of the liquid carrying conduit, and input means for supplying gas to a gas inlet of the variable impedance control means.

2. The invention defined in claim 1 wherein the variable impedance flow control means mix a diminishing amount of gas with the liquid in the liquid carrying conduit in response to an increasing pressure differential across the variable impedance flow control means and provide a variable air to liquid ratio in the liquid carrying conduit downstream of the outlet connection and wherein the amount of liquid in relation to the amount of gas increases greatly with relatively small increases in the pressure differential.

3. The invention defined in claim 1 wherein the variable impedance flow control means include a vortex chamber for producing rotation of the fluid flowing through the vortex chamber.

4. The invention defined in claim 3 wherein the vortex chamber comprises a plurality of gas inlets with each inlet aligned tangentially with respect to the inner surface of the vortex chamber.

5. The invention defined in claim 3 wherein the vortex chamber includes a shaped gas inlet having a changing internal diameter to permit controlled choking of the gas flowing through the inlet by producing a swirl of the gases in the shaped inlet.

6. The invention defined in claim 5 including a plurality of slots extending through the side wall of the shaped inlet and aligned with respect to the inner surface of the shaped inlet to produce a swirl of the gases flowing through the shaped inlet.

7. The invention defined in claim 3 wherein the input means include a second, liquid inlet for transmitting liquid from the liquid carrying conduit into the interior of the vortex chamber.

8. The invention defined in claim 7, wherein the second input comprises a tube having an inlet end connected to the liquid carrying conduit upstream of the outlet of the vortex chamber and having an outlet end disposed at a location within the vortex chamber so as to be subjected to suction produced by the acceleration of fluid flow through the vortex chamber whereby the amount of liquid introduced through the liquid input varies in response to the amount of suction exerted on the liquid tube outlet end within the vortex chamber and increases with increased gas flow through the vortex chamber.

9. The invention defined in claim 8 wherein the variable impedance flow control means are shaped to produce an acceleration of the gases flowing from the gas inlet and through the flow control means to the outlet, so that the variable impedance flow control means produces a self-choking effect by the flow of gases through the control means to produce a greater impedance to flow with increased amount of gas flow.

10. The invention defined in claim 9 wherein the liquid added from the liquid inlet produces a further increased choking at the outlet to substantially reduce gas flow through the flow control means.

* * * * *